US008983325B2

(12) United States Patent
Takeuchi

(10) Patent No.: US 8,983,325 B2
(45) Date of Patent: Mar. 17, 2015

(54) IMAGE HEATING APPARATUS

(71) Applicant: Canon Kabushiki Kaisha, Tokyo (JP)

(72) Inventor: Suguru Takeuchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/746,866

(22) Filed: Jan. 22, 2013

(65) Prior Publication Data

US 2013/0188978 A1 Jul. 25, 2013

(30) Foreign Application Priority Data

Jan. 24, 2012 (JP) ..... 2012-011904

(51) Int. Cl.
*G03G 15/20* (2006.01)

(52) U.S. Cl.
CPC ..... *G03G 15/2017* (2013.01); *G03G 15/2042* (2013.01); *G03G 2215/2035* (2013.01)
USPC ..... 399/69; 399/94; 399/334

(58) Field of Classification Search
CPC ..... G03G 15/2017; G03G 15/2046; G03G 15/2067; G03G 15/2078; G03G 15/2082; G03G 2221/1639
USPC ..... 399/69, 94, 334
See application file for complete search history.

(56) References Cited

U.S. PATENT DOCUMENTS

| | | | | |
|---|---|---|---|---|
| 5,212,528 | A * | 5/1993 | Matsuda | 399/330 |
| 8,238,770 | B2 | 8/2012 | Shimizu | |
| 2006/0088326 | A1* | 4/2006 | Nakayama | 399/329 |
| 2009/0317100 | A1 | 12/2009 | Shimizu | |
| 2012/0020710 | A1* | 1/2012 | Motoki | 399/334 |
| 2012/0155934 | A1 | 6/2012 | Takeuchi et al. | |
| 2012/0201583 | A1 | 8/2012 | Takeuchi | |
| 2012/0248097 | A1 | 10/2012 | Takeuchi et al. | |

FOREIGN PATENT DOCUMENTS

JP 2010-002691 A 1/2010

* cited by examiner

*Primary Examiner* — Ryan Walsh
(74) *Attorney, Agent, or Firm* — Fitzpatrick, Cella, Harper & Scinto

(57) ABSTRACT

An image heating apparatus includes a first rotating member configured to heat a toner image on a sheet at a nip portion, a second rotating member configured to form the nip portion cooperatively with the first rotating member, a heat conduction member configured to conduct a heat of the second rotating member in a width direction of the second rotating member in an operating position in which the heat conduction member is in contact with the second rotating member, and a fan configured to blow an air toward a predetermined region of the heat conduction member which is in the operating position.

32 Claims, 9 Drawing Sheets

IMAGE HEATING APPARATUS

BACKGROUND OF THE INVENTION

1. Field of the Invention

The present invention relates to an image heating apparatus configured to heat a toner image on a sheet. This image heating apparatus can be used in an image forming apparatus such as a copier, a printer, a facsimile, and a multifunction peripheral having a plurality of functions of those apparatus.

2. Description of the Related Art

In a conventional fixing apparatus (image heating apparatus) of an electrophotographic image forming apparatus, a toner image formed on a recording sheet (paper) is heated and pressed at a nip portion between a fixing roller (first rotating member or endless belt) and a pressure roller (second rotating member or driving roller). In this way, a fixing process (image heating process) is performed.

In such a fixing apparatus, when the fixing process is continuously performed on recording sheets each having a width smaller than a maximum width applicable to the image heating apparatus, temperatures of regions of the fixing roller on end portion sides in a longitudinal direction thereof, which are out of contact with the recording sheet, may excessively rise in comparison with temperature of a central portion (hereinafter this phenomenon is referred to as "non-sheet passing portion temperature rise").

As a countermeasure, in the fixing apparatus and the image forming apparatus described in Japanese Patent Application Laid-Open No. 2010-2691, when the non-sheet passing portion temperature rise occurs, a heat equalizing roller (heat conduction member or heat conduction roller) is brought into abutment against the pressure roller so as to disperse or transfer a heat of the pressure roller in the longitudinal direction thereof. In this way, a temperature distribution of the pressure roller in the longitudinal direction thereof is equalized. As a result, a temperature distribution in the longitudinal direction of the fixing roller in a contact relationship with the pressure roller is also equalized.

However, when the fixing process on the narrow recording sheets further continues, the temperature of the heat equalizing roller itself rises. As a result, even when the heat is equalized by bringing the heat equalizing roller into abutment against the pressure roller, the phenomenon of a non-sheet passing portion temperature rise of the fixing roller becomes unignorable.

As a countermeasure, it can be conceived that the pressure roller is cooled by blowing air from a fan onto the pressure roller. However, such a countermeasure may have an additional problem as follows.

Specifically, width sizes of the recording sheets which are subjected to image formation (pass through the fixing apparatus) vary from each other, and hence regions as non-sheet passing portions on the pressure roller vary correspondingly to such various width sizes. Thus, it is necessary to appropriately change the regions in which the pressure roller is cooled by an air.

In this way, in order to appropriately change the regions in which the pressure roller is cooled according to the various width sizes of the recording sheets, it is necessary to dispose a large number of fans in portions opposite to the pressure roller. In addition, it is necessary to determine the number of fans to be operated among the large number of fans according to a width size of a recording sheet. In this way, in addition to increases in size and cost, the control of the image heating apparatus inevitably becomes more complicated.

SUMMARY OF THE INVENTION

An embodiment according to the present invention provides an image heating apparatus configured to suppress an excessive temperature rise in a part of a first rotating member with a simple structure.

According to an embodiment of the present invention, there is provided an image heating apparatus, including: a first rotating member configured to heat a toner image on a sheet at a nip portion; a second rotating member configured to form the nip portion cooperatively with the first rotating member; a heat conduction member configured to conduct a heat of the second rotating member in a width direction of the second rotating member in an operating position in which the heat conduction member is in contact with the second rotating member; and a fan configured to blow an air toward a predetermined region of the heat conduction member which is in the operating position.

Another embodiment of the present invention provides an image heating apparatus configured to suppress an excessive temperature rise in a part of an endless belt with a simple structure.

According to another embodiment of the present invention, there is provided an image heating apparatus, including: an endless belt configured to heat a toner image on a sheet at a nip portion; a driving roller configured to form the nip portion cooperatively with the endless belt and to drive the endless belt to rotate; an exciting coil configured to inductively heat the endless belt; a plurality of magnetic cores arrayed along a width direction of the endless belt; a core moving mechanism configured to move at least one of the plurality of magnetic cores away from the endless belt when an image heating process is performed on a predetermined sheet having a width smaller than a maximum width applicable to the image heating apparatus; a heat conduction roller configured to conduct a heat of the driving roller in a longitudinal direction of the driving roller in an operating position in which the heat conduction roller is in contact with the driving roller; a detector configured to detect a temperature of a part of the endless belt on one end portion side in a longitudinal direction of the endless belt other than a region of the endless belt in which the endless belt is to be brought into contact with the predetermined sheet; a roller moving mechanism configured to move the heat conduction roller between the operating position and a non-operating position in which the heat conduction roller is spaced apart from the driving roller; a fan configured to blow an air toward a part of the heat conduction roller on one end side in a longitudinal direction of the heat conduction roller which is in the operating position so as to cool the part of the endless belt on the one end portion side in the longitudinal direction of the endless belt; and a controller configured to control an operation of the roller moving mechanism and an operation of the fan according to an output from the detector.

Further features of the present invention will become apparent from the following description of embodiments with reference to the attached drawings.

DESCRIPTION OF THE EMBODIMENTS

In the following, embodiments of the present invention will be described in detail. Note that, the present invention is not limited to a structure of each of the embodiments of the present invention, and those structures may be appropriately replaced with various known structures within a scope of the technical concept of the present invention.

Embodiments (Image Forming Apparatus)

Figure 2:
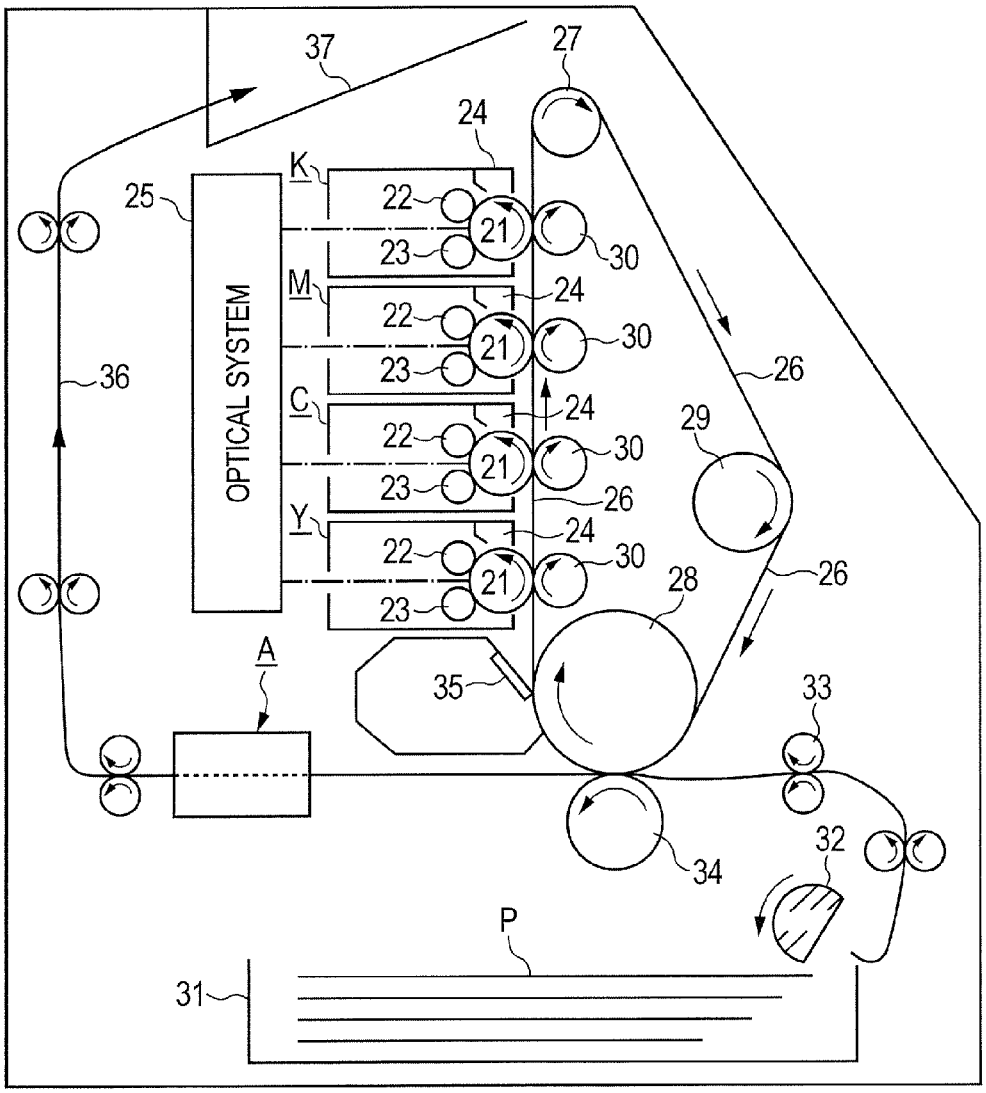
FIG. 2 is a structural model view of an image forming apparatus including the fixing apparatus.

FIG. 2 is a structural model view of an example of an image forming apparatus according to an embodiment of the present invention, which includes a fixing apparatus having a function of an image heating apparatus. This image forming apparatus is a color image forming apparatus of an electrophotographic type. Four image forming portions Y, C, M, and K are respectively configured to form color toner images of yellow, cyan, magenta, and black, and are arrayed in this order from below upwards. The image forming portions Y, C, M, and K each include a photosensitive drum 21, a charging device 22, a developing device 23, and a cleaning device 24.

A yellow toner is contained in the developing device 23 of the image forming portion Y corresponding to yellow, a cyan toner is contained in the developing device 23 of the image forming portion C corresponding to cyan, a magenta toner is contained in the developing device 23 of the image forming portion M corresponding to magenta, and a black toner is contained in the developing device 23 of the image forming portion K corresponding to black.

An optical system 25 configured to form an electrostatic latent image through exposure to the photosensitive drum 21 is provided correspondingly to the above-mentioned four color image forming portions Y, C, M, and K. The optical system 25 includes a laser scanning exposure optical system. When the optical system 25 scans a laser beam to expose the photosensitive drum 21 uniformly charged by the charging device 22 with the laser beam according to image data in each of the image forming portions Y, C, M, and K, an electrostatic latent image corresponding to a scanning exposure image pattern is formed on a surface of the photosensitive drum 21.

Then, the developing device 23 develops the electrostatic latent image into a toner image. Specifically, an yellow toner image is formed on the surface of the photosensitive drum 21 of the image forming portion Y corresponding to yellow, a cyan toner image is formed on the surface of the photosensitive drum 21 of the image forming portion C corresponding to cyan, a magenta toner image is formed on the surface of the photosensitive drum 21 of the image forming portion M corresponding to magenta, and a black toner image is formed on the surface of the photosensitive drum 21 of the image forming portion K corresponding to black.

In synchronism with rotation of each of the photosensitive drums 21, the above-mentioned color toner image formed on the surface of the photosensitive drum 21 of each of the image forming portions Y, C, M, and K is primarily transferred onto an intermediate transfer member 26 rotated at a substantially constant speed in a manner that the above-mentioned color toner images are sequentially superimposed in a predetermined registration. In this way, the above-mentioned color toner images are combined and formed into an unfixed full-color toner image on the intermediate transfer member 26. In the embodiment, an endless intermediate transfer belt is used as the intermediate transfer member 26. The intermediate transfer member 26 is stretched around the following three rollers: a driving roller 27; an opposed secondary transfer roller 28; and a tension roller 29, and is driven by the driving roller 27.

A primary transfer roller 30 is used as a unit configured to primarily transfer the toner image from the surface of the photosensitive drum 21 of each of the image forming portions Y, C, M, and K onto the intermediate transfer belt 26. A bias power source (not shown) applies a primary transfer bias having a polarity reverse to those of the toners to the primary transfer roller 30. In this way, the toner image is primarily transferred from the surface of the photosensitive drum 21 of each of the image forming portions Y, C, M, and K onto the intermediate transfer belt 26. In each of the image forming portions Y, C, M, and K, after the toner image is primarily transferred from the surface of the photosensitive drum 21 onto the intermediate transfer belt 26, the cleaning device 24 removes untransferred residual toner remaining on the surface of the photosensitive drum 21.

In synchronism with the rotation of the intermediate transfer belt 26, the step described above is performed with respect to each of the colors of yellow, magenta, cyan, and black. Primarily transferred toner images of those colors are formed by being sequentially superimposed onto the intermediate transfer belt 26 in this way. Note that, in order to perform monochromatic image formation (monochromatic mode), the step described above is performed with respect only to a selected color.

Meanwhile, a feed roller 32 separates one by one recording sheets (such as sheets and recording materials) P contained in a cassette 31 and feeds the recording sheet P. Then, at a predetermined timing, a registration roller pair conveys the recording sheet P into a transfer nip portion as a pressure contact portion in which a part of the intermediate transfer belt 26, which is wrapped around the opposed secondary transfer roller 28, and a secondary transfer roller 34 are in pressure contact with each other.

The primarily-transferred combined toner image formed on the intermediate transfer belt 26 is secondarily transferred collectively onto the recording sheet P with a bias applied from a bias power source (not shown) to the secondary transfer roller 34, the bias having a polarity reverse to those of the toners. An intermediate transfer belt cleaning device 35 removes untransferred residual toner remaining on the intermediate transfer belt 26 after the secondary transfer. The toner image secondarily transferred on the recording sheet P is fused and mixed in color by a fixing apparatus A as an image heating apparatus so as to be fixed to the recording sheet P, and then delivered as a full color print onto a delivery tray 37 via a delivery path 36.

(Fixing Apparatus)

(1) Definitions of Directions

In the following description, a longitudinal direction of the fixing apparatus A or components of the fixing apparatus A (width direction or axial direction) is a direction parallel to a direction orthogonal to a recording sheet conveying direction in a plane of a recording sheet conveying path of the fixing apparatus A. Further, a lateral direction is a direction parallel to the recording sheet conveying direction of the fixing apparatus A. With regard to the fixing apparatus A, a front surface of the fixing apparatus A is a surface as viewed from a recording sheet inlet side, a back surface is a surface as viewed from the opposite side (as viewed from the recording sheet outlet side), and the left and the right respectively are the left and the right with respect to the direction in which the fixing apparatus A is viewed from the front surface. An upstream side and a downstream side respectively are an upstream side and a downstream side in the recording sheet conveying direction.

(2) Overall Structure

Figure 1:
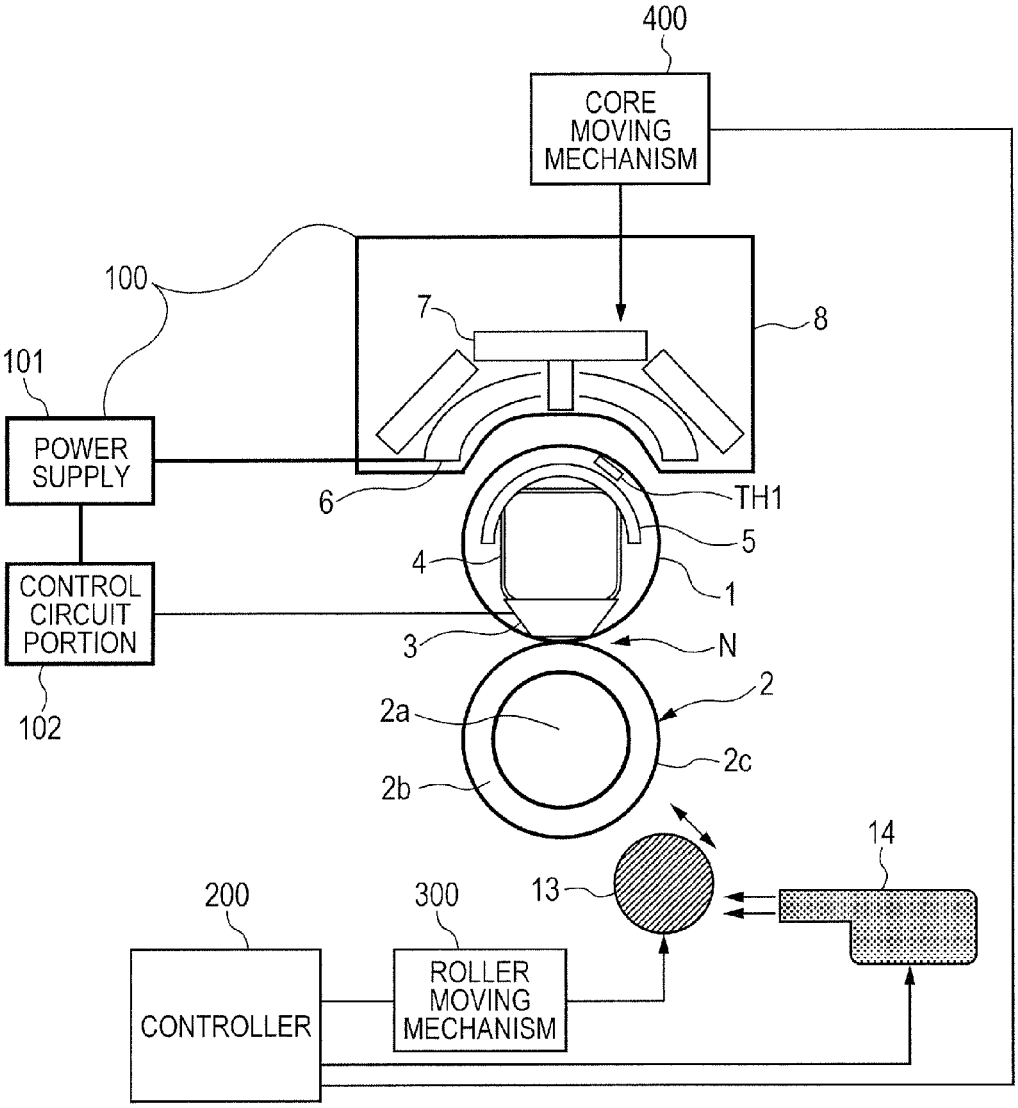
FIG. 1 is a vertical sectional view of a substantial part of a fixing apparatus, for illustrating a control system of the fixing apparatus.

FIG. 1 is a vertical sectional view of a substantial part of the image heating apparatus according to the embodiment, for illustrating a control system of the fixing apparatus. A fixing belt (first rotating member or heating rotating member) 1 is an endless belt including a metal layer. A pressure roller (second rotating member or pressure rotating member) 2 is arranged in contact with an outer periphery of the fixing belt 1. A pressure pad 3 serves as a backup member which generates a pressing force between the fixing belt 1 and the pressure roller 2 so that a fixing nip portion N is formed, the pressure pad 3 being supported by a metal stay 4. Further, on a coil side of the stay 4, there is provided a magnetic field blocking core 5 configured to prevent an excessive temperature rise of the stay 4 caused by induction heating.

Figure 4:
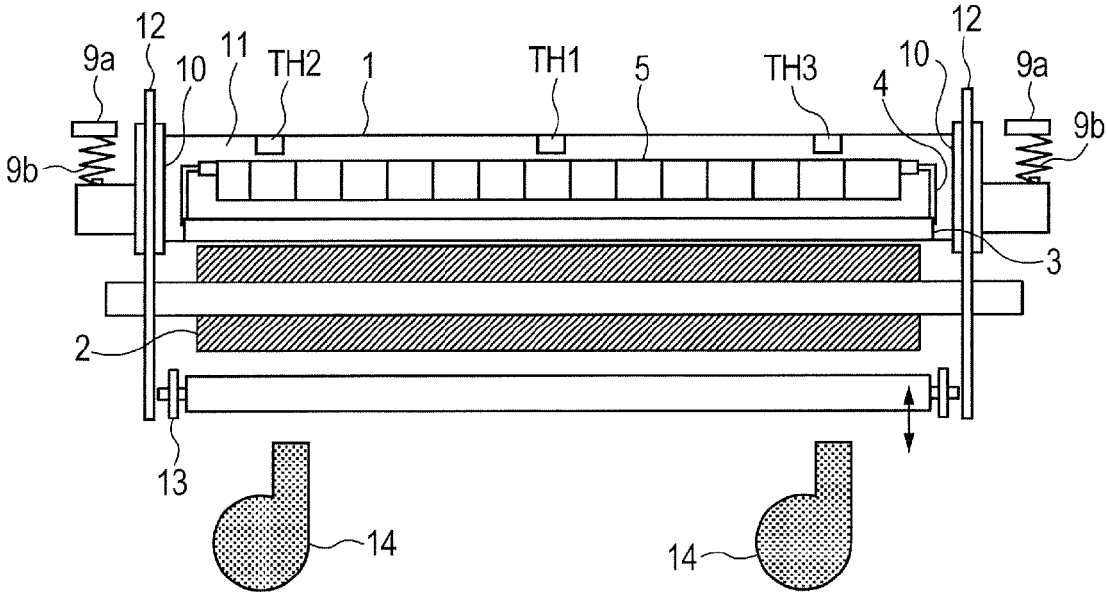
FIG. 4 is a longitudinal sectional front view of the fixing apparatus.

In FIG. 4, left and right fixing flanges 10 each serve as a regulating member configured to regulate movement of the fixing belt 1 in the longitudinal direction thereof and a shape of the fixing belt 1 in a circumferential direction thereof. Stay pressure springs 9*b* are provided to be compressed respectively between both end portions of the stay 4 inserted through the fixing flanges 10 and stay spring receiving members 9*a* provide on an apparatus chassis. With this, a press-down force is applied to the stay 4. In this way, lower surfaces of the fixing flanges 10 and an upper surface of the pressure roller 2 are brought into pressure contact with each other in a manner that the fixing belt 1 is nipped therebetween. As a result, the fixing nip portion N having a predetermined width is formed.

The fixing apparatus A includes an induction heating device 100 as a heating source configured to inductively heat the fixing belt 1. This induction heating device 100 includes an exciting coil 6 as a magnetic flux generating unit obtained by winding an electric wire such as a litz wire into a horizontally long ship bottom shape so that the exciting coil 6 is opposite to a peripheral surface and a part of side surfaces of the fixing belt 1. Further, in order that a magnetic field generated by the exciting coil 6 is not leaked to a part other than the metal layer (conductive layer) of the fixing belt 1, the induction heating device 100 includes a plurality of (a large number of) magnetic cores 7 arrayed along a rotational direction of the fixing belt 1 (to cover the exciting coil 6), and a mold member 8 made of an electric insulating resin and configured to support the magnetic cores 7.

The induction heating device 100 is disposed opposite to an upper side of an outer peripheral surface of the fixing belt 1 with a predetermined gap (clearance) between the induction heating device 100 and the fixing belt 1. In non-sheet passing portions, clearances between the exciting coil 6 and the magnetic cores 7 are expanded so that the density of magnetic fluxes passing through the fixing belt 1 is lowered, to thereby reduce the heat generation amount of the fixing belt 1. The magnetic cores 7 function as a magnetic flux suppressing mechanism configured to change the density distribution of the magnetic fluxes, which are generated from the exciting coil 6 as the magnetic flux generating unit so as to act on the fixing belt 1, in a direction (longitudinal direction) intersecting the recording sheet conveying direction.

In state in which the fixing belt 1 is rotated, a power supply (excitation circuit) 101 applies a high-frequency current of from 20 kHz to 50 kHz to the exciting coil 6 of the induction heating device 100 so that the exciting coil 6 generates a magnetic field. With this magnetic field, the metal layer (conductive layer) of the fixing belt 1 is inductively heated. A temperature sensor (detector or temperature detecting element) TH1 such as a thermistor is arranged at a center in the width direction of the fixing belt 1 and in a position on a side of an inner peripheral surface of the fixing belt 1 so that the temperature sensor TH1 abuts against the inner peripheral surface of the fixing belt 1. Note that, end portion temperature sensors (detector or temperature detecting element) TH2 and TH3 described later are also arranged respectively at both end portions in the width direction of the fixing belt 1.

In the embodiment, the recording sheet P is conveyed with reference to a central portion in the width direction of the recording sheet P as a sheet passing reference. In other words, the recording sheet P is conveyed in a manner that the central portion in the width direction of the recording sheet P substantially corresponds to a central portion in the width direction of the fixing apparatus A (fixing belt 1). Thus, the temperature sensor TH1 detects a temperature of a part of the fixing belt 1 (part of the central portion in the width direction of the fixing belt 1), and feeds back information of the detection temperature to a control circuit portion 102. The part of the fixing belt 1 falls within such a region through which all the recording sheets P of various width sizes, which are applicable to the fixing apparatus A, pass. The control circuit portion 102 controls electric power input from the power supply 101 to the exciting coil so that a detection temperature input from the temperature sensor TH1 is maintained at a predetermined target temperature (fixing temperature).

In other words, when the detection temperature of the fixing belt 1 rises to a predetermined temperature, energization to the exciting coil 6 is interrupted. In the embodiment, in order to maintain a temperature of 180° C., which is the target temperature of the fixing belt 1, the frequency of the high-frequency current is changed based on a value detected by the temperature sensor TH1. In this way, the electric power input to the exciting coil 6 is controlled so as to adjust the temperature of the fixing belt 1. The temperature sensor TH1 described above is fixed to the pressure pad 3 through an elastic support member. With this, even when a position of an abutment surface of the fixing belt 1 varies due to an undulating state of the fixing belt 1, the temperature sensor TH1 can follow the positional variation, and can be maintained in a satisfactory contact state.

At least during execution of image formation, the fixing belt 1 is driven and rotated at a circumferential speed substantially equal to a conveying speed of the recording sheet P bearing the unfixed toner image in association with rotation of the pressure roller 2 which is driven and rotated by a motor (driving unit) controlled by the control circuit portion 102. In other words, in the embodiment, the pressure roller 2 has a function of a driving roller configured to drive and rotate the fixing belt 1. In the embodiment, the fixing belt 1 is rotated at a surface rotational speed of 300 mm/sec, at which full color images can be fixed onto eighty (80) recording sheets of A4 size per minute, and fifty-eight (58) recording sheets of A4R size per minute.

Through electric power supply from the power supply 101 controlled by the control circuit portion 102 to the exciting coil 6 of the induction heating device 100, the temperature of the fixing belt 1 rises to and is maintained at a predetermined fixing temperature. In this state, a guide member guides and introduces the recording sheet P, on which an unfixed toner image T has been transferred, into between the fixing belt 1 and the pressure roller 2 at the fixing nip portion N with a toner image bearing side of the recording sheet P facing toward the fixing belt 1.

Then, the recording sheet P adheres to the outer peripheral surface of the fixing belt 1 at the fixing nip portion N, and together with the fixing belt 1, is conveyed through the fixing nip portion N while being nipped between the fixing belt 1 and the pressure roller 2. With this, heat is imparted mainly from the fixing belt 1, and a pressure force of the fixing nip portion N is applied to the recording sheet P. As a result, the unfixed toner image T is fixed onto a surface of the recording sheet P by heat and pressure. After passing through the fixing nip portion N, the surface of the recording sheet P is self-stripped from the outer peripheral surface of the fixing belt 1 by a stiffness of the recording sheet P itself and with a deformed shape of an outlet part of the fixing nip portion N. In this way, the recording sheet P is conveyed to the outside of the fixing apparatus A.

(3) Fixing Belt

Figure 3:
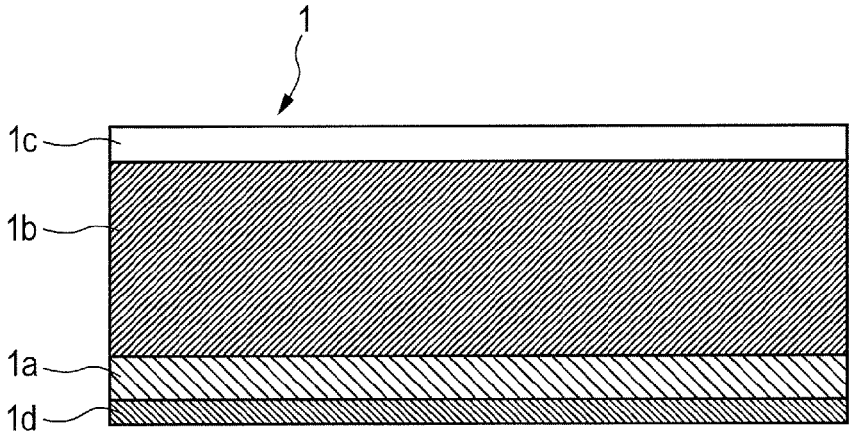
FIG. 3 is a structural view of layers of a fixing belt.

FIG. 3 is a structural model view of the layers of the fixing belt 1. The fixing belt 1 has a longitudinal length of 390 mm. The fixing belt 1 has an inner diameter of 30 mm, and includes a nickel base layer (metal layer) 1*a* manufactured by an electroforming method. The base layer 1*a* has a thickness of 40 μm. On an outer periphery of the base layer 1*a*, there is provided a heat-resistant silicone rubber layer as an elastic layer 1*b*. It is preferred to set a thickness of the heat-resistant silicone rubber layer within a range of from 100 μm to 1,000 μm.

In the embodiment, in order to achieve a shorter warm-up time by reduction of a heat capacity of the fixing belt 1 and to obtain a satisfactory permanent image through fixation of the color images, the thickness of the silicone rubber layer is set to 300 μm. This silicone rubber has a JIS-A hardness of 20 degrees and a heat conductivity of 0.8 W/mK. Further, on an outer periphery of the elastic layer 1*b*, there is provided a fluorine resin layer (such as PFA and PTFE) having a thickness of 30 μm as a surface releasing layer 1*c*.

On an inner surface side of the base layer 1*a*, there may be provided a resin layer (lubricating layer) 1*d* made of a fluorine resin or polyimide with a thickness of from 10 μm to 50 μm so as to reduce sliding friction between the inner surface of the fixing belt 1 and the temperature sensor TH1. In the embodiment, a polyimide layer having a thickness of 20 μm is provided as the resin layer 1*d*.

Note that, as a material for the metal layer 1*a* of the fixing belt 1, a material such as nickel, a steel alloy, copper, and silver may be appropriately selected. Alternatively, there may be provided a resin base layer on which layers made of those metals are laminated. The thickness of the metal layer 1*a* may be appropriately adjusted according to the following factors described in detail later: the frequency of the high-frequency current which flows through the exciting coil 6; and a magnetic permeability and an electrical conductivity of the metal layer 1*a*. It is preferred that the thickness of the metal layer 1*a* be set within a range of from approximately 5 μm to 200 μm.

(4) Pressure Roller

The pressure roller (pressure rotating member) 2 configured to form the fixing nip portion N between the pressure roller 2 and the fixing belt 1 has an outer diameter of 30 mm, and is formed of a metal core 2*a* made of a steel alloy having a longitudinal central portion having a diameter of 20 mm and both end portions each having a diameter of 19 mm, and a silicone rubber layer as an elastic layer 2*b* provided around the metal core 2*a*. On a surface of the elastic layer 2*b*, there is provided a fluorine resin layer (such as PFA and PTFE) having a thickness of 30 μm as a surface releasing layer 2*c*. Further, the pressure roller 2 has a longitudinal length of 350 mm.

The longitudinal central portion of the pressure roller 2 has an Asker-C hardness of 70 degrees. The metal core 2*a* is tapered so that the pressure at the fixing nip portion formed between the fixing belt 1 and the pressure roller 2 is equalized over the longitudinal direction even when the pressure pad (pressing member) 3 is deflected at the time of pressing. In the embodiment, under a fixing nip pressure of 600 N, the width of the fixing nip portion between the fixing belt 1 and the pressure roller 2 along the rotational direction varies as follows: approximately 9 mm at each end portion in the longitudinal direction; and approximately 8.5 mm at the central portion in the longitudinal direction. With this width, the recording sheet P is conveyed at a higher speed at both the end portions than at the central portion, which leads to an advantage that sheet wrinkling is less liable to occur.

(5) Pressure Pad

FIG. 4 is a longitudinal sectional front view of the fixing apparatus A as the image heating apparatus according the embodiment. The left and right fixing flanges 10 each serve as the regulating member configured to regulate the movement of the fixing belt 1 in the longitudinal direction thereof and the shape of the fixing belt 1 in the circumferential direction thereof. The stay pressure springs 9*b* are provided to be compressed respectively between both the end portions of the stay 4 inserted through the fixing flanges 10 and the stay spring receiving members 9*a* provided on the apparatus chassis. With this, a press-down force is applied to the stay 4. In this way, the lower surfaces of the fixing flanges 10 and the upper surface of the pressure roller 2 are brought into press contact with each other in a manner that the fixing belt 1 is nipped therebetween. As a result, the fixing nip portion N having a predetermined width is formed.

With this, the elastic layer 2*b* of the pressure roller 2 and the fixing belt 1 are prevented from being deformed. The pressure pad 3 serves as the backup member which generates the pressing force between the fixing belt 1 and the pressure roller 2 by coming into contact with the inner peripheral surface of the fixing belt 1 so that the fixing nip portion N is formed, the pressure pad 3 being held by the metal stay 4. The pressure pad 3 is made of a heat-resistant resin, and the stay 4 needs to be rigid enough to apply a pressure to the pressure contact portion, and hence is made of steel in the embodiment.

Further, both end portions of the pressure pad 3 are particularly close to the exciting coil 6. In order to block the magnetic field generated by the exciting coil 6 and to prevent heat generation of the pressure pad 3, the magnetic field blocking core 5 is arranged in the longitudinal direction over an upper surface of the pressure pad 3. Further, the base layer 1*a* of the fixing belt 1 to be rotated is made of a metal. Therefore, as a unit configured to restrict lateral movement of the fixing belt 1 in the width direction thereof even in a rotational state, it suffices that the fixing flanges 10, configured to simply receive both the end portions of the fixing belt 1, are provided.

With this, there is an advantage that the structure of the fixing apparatus A can be simplified. Support side plates 12 are configured to support the fixing belt 1. The support side plates 12 regulate the position of the fixing belt 1 in the longitudinal direction.

(6) Induction Heating Device

In the embodiment, a mold having a thickness of 0.5 mm maintains the fixing belt 1 and the exciting coil 6 of the induction heating device 100 in an electrically insulated state while securing a predetermined clearance of 1.5 mm between the fixing belt 1 and the exciting coil 6 (a predetermined clearance of 1.0 mm between a surface of the mold and the surface of the fixing belt 1). With this, the fixing belt 1 is uniformly heated.

Through application of the high-frequency current of from 20 kHz to 50 kHz to the exciting coil 6, the metal layer 1*a* of the fixing belt 1 is inductively heated. In order to maintain the temperature of the fixing belt 1 at 180° C., which is the target temperature, the frequency of the high-frequency current is changed based on the value detected by the temperature sensor TH1. In this way, the electric power input to the exciting coil 6 is controlled so as to adjust the temperature of the fixing belt 1.

The induction heating device 100 including the exciting coil 6 is arranged not in the inside of the fixing belt 1, in which the temperature becomes higher, but on the outside of the fixing belt 1. Thus, the temperature of the exciting coil 6 is less liable to become higher, and hence the electrical resistance does not become higher. Therefore, even when a high-frequency current flows, Joule heating loss can be reduced. Further, the exciting coil 6 is arranged on the outside of the fixing belt 1, and hence the fixing belt 1 is reduced in diameter (in heat capacity), which leads also to higher energy saving properties.

The warm-up time of the fixing apparatus A in the embodiment will be described. The heat capacity of the fixing apparatus A in the embodiment is set to be markedly low. Thus, when, for example, electric power of 1,500 W is input to the exciting coil 6, the temperature of the fixing belt 1 can reach the target temperature of 180° C. in approximately 15 seconds. In addition, it is unnecessary to perform a heating operation during a standby mode, and hence electric power consumption can be suppressed to be markedly low.

(7) Core Moving Mechanism

Figure 5:
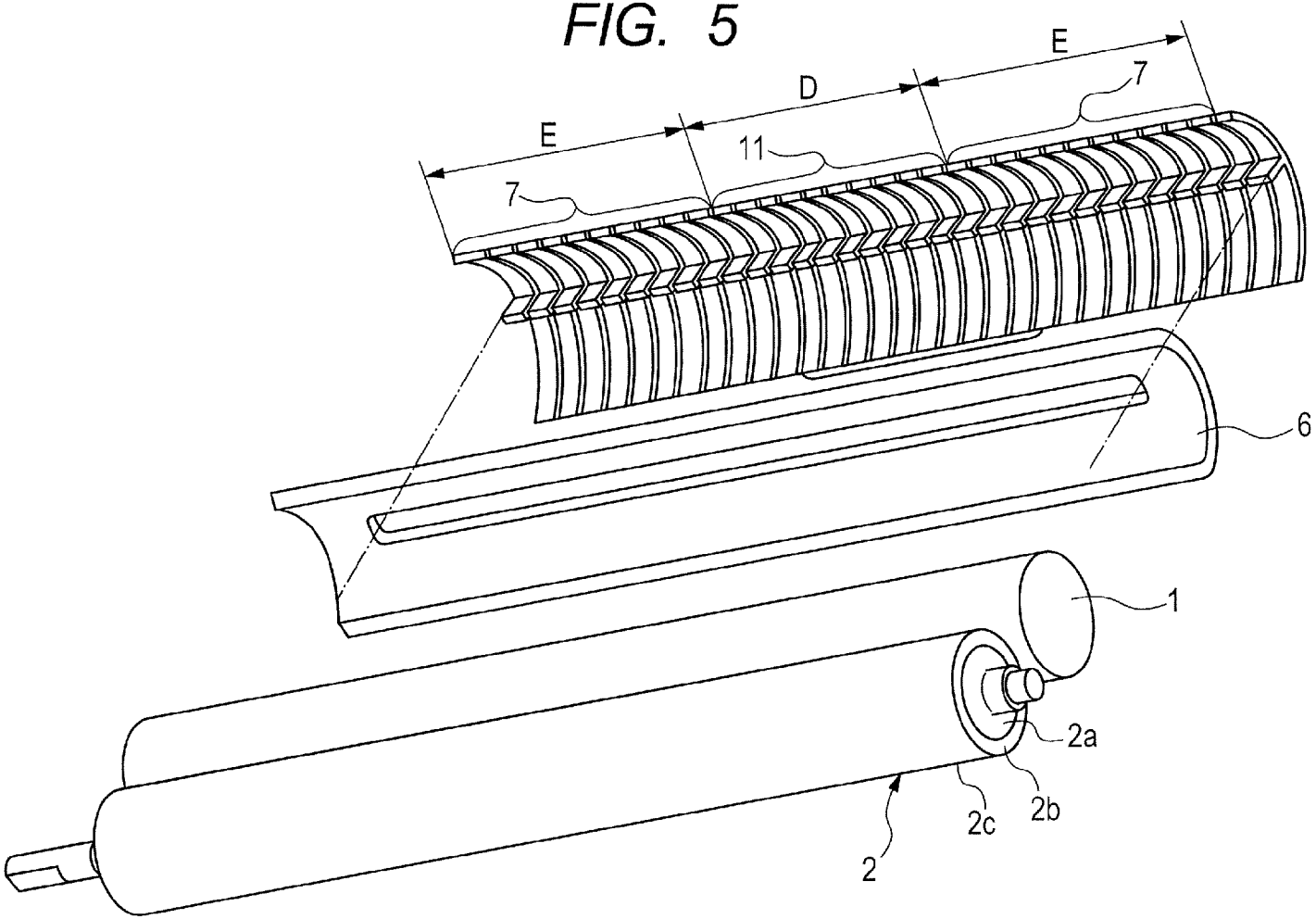
FIG. 5 is a schematic developed view of a core moving mechanism.

As illustrated in FIG. 5, the large number of magnetic cores 7 and 11 are arranged side by side in the direction (the longitudinal direction) orthogonal to the recording sheet conveying direction in a manner that a winding core portion of the exciting coil 6 and a periphery thereof are surrounded. The magnetic cores 7 are magnetic cores in a region E at each end portion of the sheet passing portion, and can be moved with a core moving mechanism 400. An operation of this core moving mechanism 400 is controlled by a control unit (controller) 200 according to the width size of the recording sheet P. Further, the magnetic cores 11 are cores in a region D of a sheet passing center, and fixed to a housing (not shown). Note that, the region D has a sheet passing region width corresponding to small size sheet widths, and a total width of the region D and the regions E corresponds to a sheet passing region width corresponding to large size sheet widths.

The magnetic cores 7 and 11 function to guide alternating magnetic fluxes, which are generated by the exciting coil 6, efficiently to the fixing belt 1. In other words, the magnetic cores 7 and 11 are used for enhancing the efficiency of a magnetic circuit (magnetic path) and for blocking the magnetic field. As a material for the magnetic cores 7 and 11, it is preferred to use a material such as ferrite having a high magnetic permeability and a low residual magnetic flux density.

Figure 6:
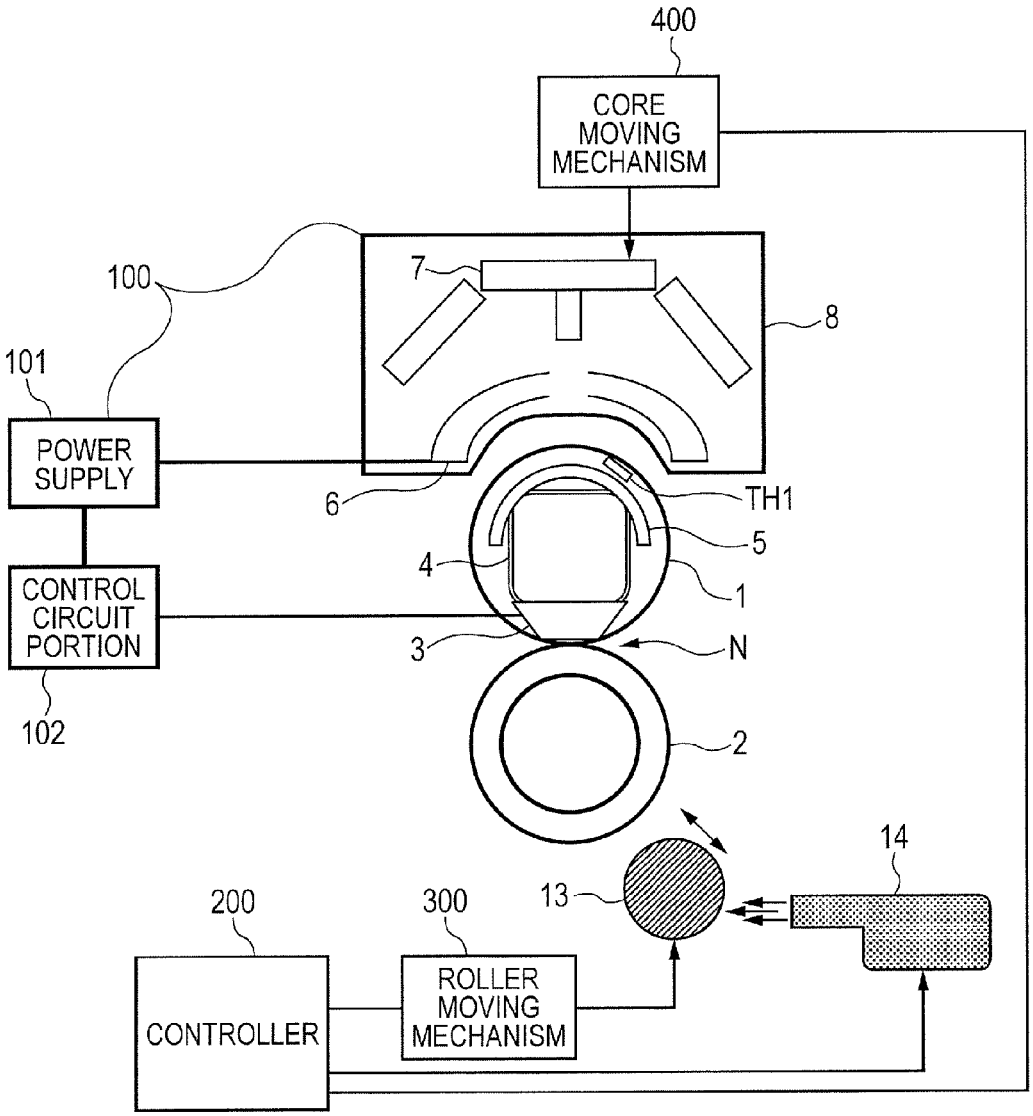
FIG. 6 is a schematic view illustrating a state in which magnetic cores of the fixing apparatus are moved.

At the time of a fixing process on sheets of various width sizes, such as a postcard and sheets of the following sizes: A5; B4; A4; and A3 plus, in order to prevent excessive temperature rises at the non-sheet passing portions, in the region E at each of the end portions of the sheet passing portion, the magnetic cores 7 are divided into a plurality of pieces in the direction orthogonal to the recording sheet conveying direction. As illustrated in FIG. 6, in regions which are changed into the non-sheet passing regions by the core moving mechanism 400 according to sheet sizes, the magnetic cores 7 are moved in a direction away from the exciting coil 6 (fixing belt 1). In this way, the density of the magnetic fluxes with respect to the fixing belt 1 is partially reduced. In the embodiment, the exciting coil 6 has a longitudinal inner diameter of 352 mm and a longitudinal outer diameter of 392 mm. The magnetic cores 7 each have a longitudinal width of 10 mm, and are arranged at intervals of 1.0 mm.

A heat equalizing roller 13 functions as a heat conduction member. When the fixing process is continuously performed on recording sheets having a small width size, the regions to be the non-sheet passing portions on the fixing belt 1 tend to excessively rise in temperature in comparison with the sheet passing portion. In such a case, the heat equalizing roller 13 is brought into contact with the pressure roller 2 so that the heat of the pressure roller 2 is transferred in the longitudinal direction. In this way, generation of excess temperature gradients is suppressed in the longitudinal direction of the pressure roller 2. As a result, also in the width direction of the fixing belt 1 in a contact relationship with the pressure roller 2, generation of excess temperature gradients is suppressed.

A heat equalizing roller 13 functions as a heat conduction member. When the fixing process is continuously performed on recording sheets having a small width size, the regions to be the non-sheet passing portions on the fixing belt 1 tend to excessively rise in temperature in comparison with the sheet passing portion. In such a case, the heat equalizing roller 13 is brought into contact with the pressure roller 2 so that a heat of the pressure roller is transferred in the longitudinal direction. In this way, generation of excess temperature gradients is suppressed in the longitudinal direction of the pressure roller 2. As a result, also in the width direction of the fixing belt 1 in a contact relationship with the pressure roller 2, generation of excess temperature gradients is suppressed.

In other words, the heat equalizing roller 13 suppresses unevenness in temperature distribution in the longitudinal direction of each of the fixing belt 1 and the pressure roller 2. The heat equalizing roller 13 includes a metal roller formed, for example, of an aluminum base material or a copper base material. On a surface layer of the metal roller, for example, there is provided a fluorine coating having a thickness of 20 μm so as to prevent adhesion of dust.

The fixing belt 1, the pressure roller 2, and the heat equalizing roller 13 are arrayed parallel to each other, and both end portions of the heat equalizing roller 13 are supported to be rotatable by bearing members (not shown). The heat equalizing roller 13 can be moved by a roller moving mechanism 300 (FIG. 1) including a spring between a position in which the heat equalizing roller 13 is in contact with the pressure roller 2 and a position in which the heat equalizing roller 13 is spaced apart from the pressure roller 2. Further, while being held in contact with the pressure roller 2, the heat equalizing roller 13 is rotated along with rotation of the pressure roller 2.

(9) Cooling Mechanism (Fan)

In the embodiment, there are set two end portion fans 14 each having a function to suppress non-sheet passing portion temperature rises in the fixing belt 1, which may occur at the time when the fixing process is continuously performed on the recording sheets having a width smaller than a maximum width size (in the embodiment, A3 size sheet) applicable to the image heating apparatus. Those end portion fans 14 are arranged to respectively face the regions on both the end sides in the longitudinal direction of the heat equalizing roller 13. In the following, only one of the end portion fans 14 will be described representatively, and the same applies to the other end portion fan 14.

The end portion fan 14 blows air toward a region on one end side of the heat equalizing roller 13 in the longitudinal direction. In this way, a cooling operation with respect to this region is performed. Activation and deactivation of the end portion fan 14 are controlled based on temperature information obtained from the end portion temperature sensors TH2 and TH3 during a job of continuously performing the fixing process (image heating process) on a plurality of recording sheets P. Note that, the activation and the deactivation of the end portion fan 14 may be controlled based on the number of sheets (number of recording sheets P) which are subjected to the fixing process during the job of continuously performing the fixing process (image heating process) on a plurality of recording sheets P. The end portion fan 14 may further include an air amount control unit configured to increase the amount of an air to be supplied from the end portion fan 14 according to a rise in detection temperature obtained from the end portion temperature sensors TH2 and TH3.

In the embodiment, as illustrated in FIG. 4, the end portion fan 14 is disposed opposite to the region on the end portion side in the longitudinal direction of the heat equalizing roller 13, and blows an air toward this region. The end portion fan 14 includes a duct so that the air is blown toward the heat equalizing roller 13. In the embodiment, the end portion fan 14 may include a centrifugal fan such as a sirocco fan. In this case, by changing a voltage input to the sirocco fan, the amount of the air to be supplied can be adjusted.

(10) Sequence of Continuous Fixing Processes on Small Size Recording Sheets

Next, a sequence of continuous fixing processes on predetermined recording sheets having a width smaller than a maximum width size applicable to the image heating apparatus (for example, in a case where sheets of A4 (A4R) size are fed in the short edge feed) will be described. Specifically, in this description of the sequence, at an ambient temperature of 15° C., a hundred and fifty (150) OK Top Coat sheets (A4R) having a basis weight of 157 g/m$^2$ are continuously supplied.

Figure 7:
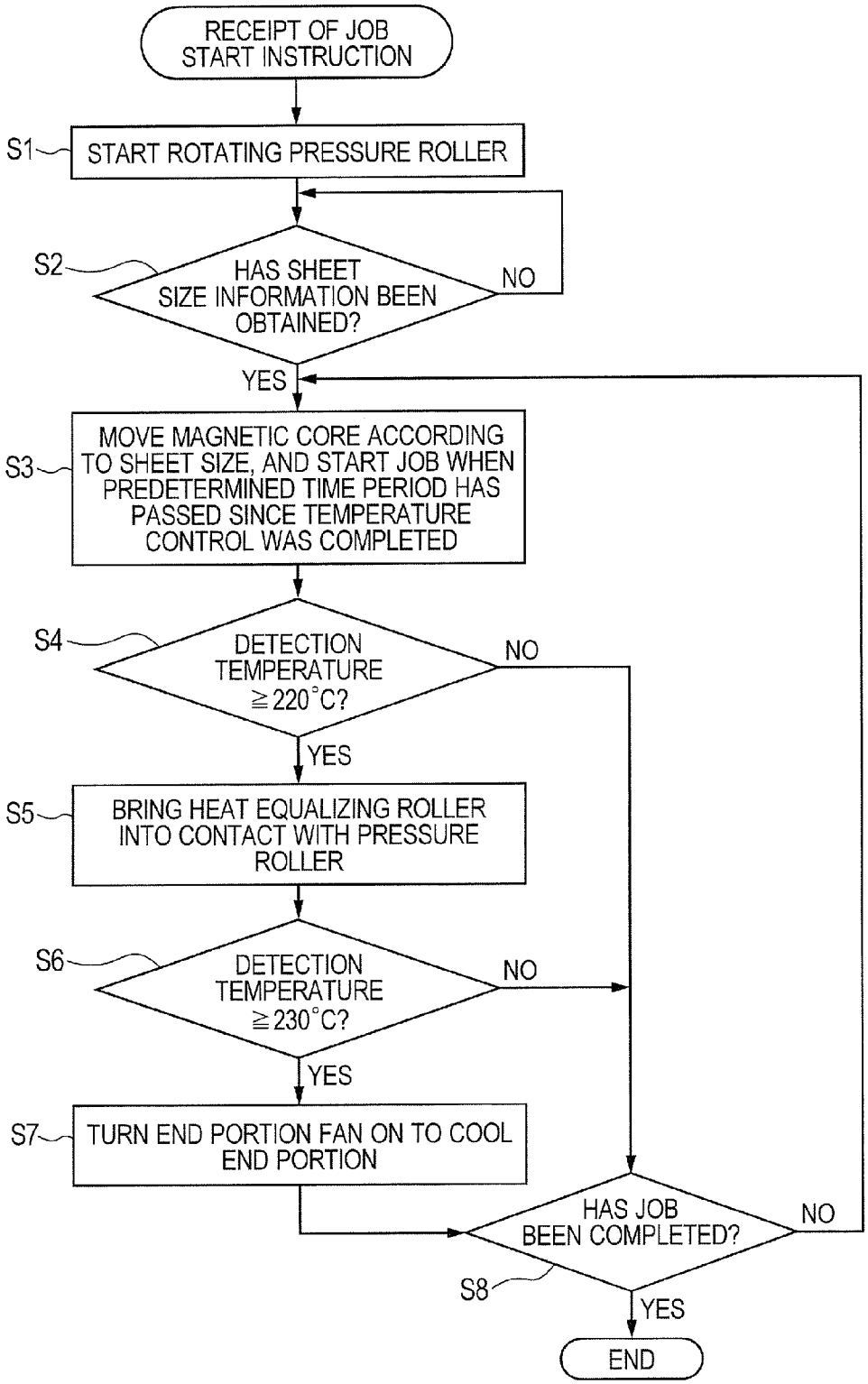
FIG. 7 is a flowchart illustrating a sequence of a job of continuously performing a fixing process on a small size sheet.

The sequence described below is executed by the control unit (controller) 200 controlling operations of various devices (FIG. 7).

First, when the image forming apparatus receives a print instruction (receives a job start instruction), the fixing apparatus A is activated, and a print preparation operation (warm-up operation) is started (S1). Specifically, the pressure roller 2 starts to be driven, and according thereto, the fixing belt 1 is rotated. Then, the exciting coil 6 also starts to be energized.

Next, when width size information of a recording sheet to be printed is obtained (identified) (S2), at least one of the magnetic cores 7 is moved away by the core moving mechanism 400 (S3) according to a size of the recording sheet. Specifically, the magnetic core 7, which is disposed opposite to the non-sheet passing regions, is moved away from the fixing belt 1. Note that, in the embodiment, in terms of downsizing the image heating apparatus, it is difficult to increase the distance by which the magnetic cores 7 are moved away to an extent that temperatures do not rise at the non-sheet passing portions of the fixing belt 1. Thus, even when the magnetic cores 7 are moved, the temperatures inevitably rise in the regions of the non-sheet passing portions of the fixing belt 1.

Then, a print operation (operation of the fixing process) is started. After that, during continuous fixing processes on the recording sheets P, the temperatures of the regions to be the non-sheet passing portions on the fixing belt 1 are monitored. Specifically, whether or not the detection temperatures obtained from the end portion temperature sensors TH2 and TH3 have risen to 220° C. is checked (S4). Note that, in the embodiment, the energization to the exciting coil 6 is controlled so that the detection temperature obtained from the center temperature sensor TH1 is maintained at 180° C.

When the detection temperatures obtained from the end portion temperature sensors TH2 and TH3 rise to 220° C. as a result of fixing processes on subsequent recording sheets P (in the embodiment, after a fixing process on the 27th sheet is completed), the heat equalizing roller 13 is brought into abutment against the pressure roller 2 by the roller moving mechanism 300 (S5). Note that, thresholds of the detection temperatures obtained from the end portion temperature sensors TH2 and TH3, based on which the heat equalizing roller 13 is brought into abutment against the pressure roller 2, may be changed according to sheet sizes, sheet types, or productivity. Note that, in the embodiment, the heat equalizing roller 13 is not brought into abutment against the pressure roller 2 from an initial stage of the printing. This is because, during the warm-up operation (rising the temperature of the fixing belt 1 from room temperature to the target fixing temperature), the heat of the fixing belt 1 is transferred to the heat equalizing roller 13 via the pressure roller 2. Thus, a time period required for the warm-up operation can be shortened as much as possible, and hence it is more preferred that the heat equalizing roller 13 be not brought into abutment against the pressure roller 2 during the warm-up operation.

Then, whether or not the detection temperatures obtained from the end portion temperature sensors TH2 and TH3 have further risen to 230° C. as a result of increase in the number of fixing processes on further subsequent recording sheets P is checked (S6). When the detection temperatures obtained from the end portion temperature sensors TH2 and TH3 rise to 230° C., the two end portion fans 14 are activated (turned on) (S7).

Note that, when the temperatures of the non-sheet passing portions of the fixing belt 1 reach 230° C. (in the embodiment, after a fixing process on the 100th sheet is completed), the pressure roller 2 may be directly cooled by the end portion fans 14 so as to reduce non-sheet passing portion temperature rises in the fixing belt 1. However, as described above, in the embodiment, the heat equalizing roller 13 is cooled by the end portion fans 14.

This is because the width sizes (except the maximum width size) of the recording sheets P which are subjected to image formation (pass through the fixing apparatus A) vary from each other, and hence the regions to be the non-sheet passing portions on the pressure roller 2 vary to correspond to such various width sizes. In other words, in the former case where the pressure roller 2 is directly cooled by the end portion fans 14, it is necessary to successively change regions in which the pressure roller 2 is cooled by an air. In this way, in order to successively change the regions in which the pressure roller 2 is directly cooled according to the various width sizes of the recording sheets P, it is necessary to array a large number of fans at opposed portions with respect to the pressure roller 2, and in addition, to control the number of fans to be operated among the large number of fans according to the various width sizes of the recording sheets P. In this way, in addition to increases in size and cost, the control of the image heating apparatus inevitably becomes more complicated.

The control unit 200 determines whether or not the job has been completed (S8). When the job is determined not to have been completed, the process returns to S3. When the job is determined to have been completed, the sequence described above is completed.

Figure 8:
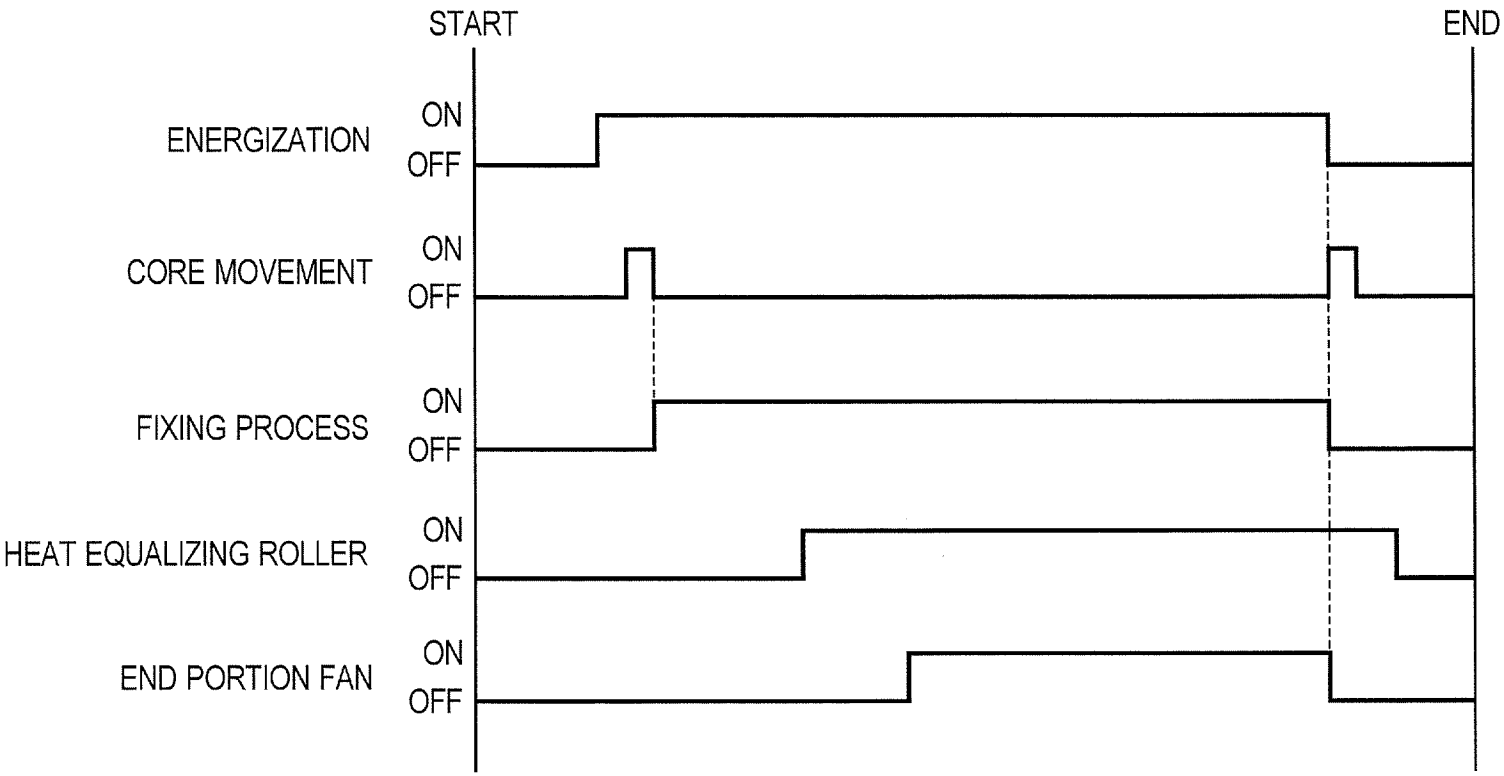
FIG. 8 is a timing chart of the job of continuously performing the fixing process on the small size sheet.

FIG. 8 is a timing chart of the sequence described above. "Start" represents a time point when the print instruction is received, and "End" represents a time point when a post process is completed (start of a time period for waiting the print instruction).

First, "Energization" will be described. As illustrated in FIG. 8, the ON state of "Energization" indicates that energization to the exciting coil 6 is started in response to the receipt of the print instruction, and the energization is controlled so that the temperature of the fixing belt 1 is maintained at the target temperature. In other words, the ON state of "Energization" indicates that such energization control is performed.

Next, "Core Movement" will be described. As illustrated in FIG. 8, the ON state of "Core Movement" indicates that, after the warm-up process of the fixing apparatus A is completed (temperature of the fixing belt 1 reaches the target temperature), in order to move at least one of the magnetic cores 7 away from the fixing belt 1 according to the width sizes of the recording sheets P prior to sheet entry into the fixing apparatus A, energization control on the core moving mechanism is performed. In other words, the ON state of "Core Movement" indicates that at least one of the magnetic cores 7 is moved.

Next, "Fixing Process" will be described. As illustrated in FIG. 8, the ON state of "Fixing Process" indicates a time period between entry of a first recording sheet into the fixing apparatus A (nip portion N) and completion of passage of the last recording sheet through the fixing apparatus A. In other words, the ON state of "Fixing Process" indicates that the recording sheets P are continuously supplied to the fixing apparatus A.

Next, "Heat Equalizing Roller" will be described. As illustrated in FIG. 8, the ON state of "Heat Equalizing Roller" indicates a time period in which the heat equalizing roller 13 is in abutment against the pressure roller 2. In other words, the ON state of "Heat Equalizing Roller" indicates that the heat equalizing roller 13 is in abutment against the pressure roller 2.

Lastly, "End Portion Fan" will be described. As illustrated in FIG. 8, the ON state of "End Portion Fan" indicates a time period in which the two end portion fans 14 are energized so that air is blown from those two end portion fans 14 toward the heat equalizing roller 13. In other words, the ON state of "End Portion Fan" indicates that the end portion fans 14 are activated.

Figure 9:
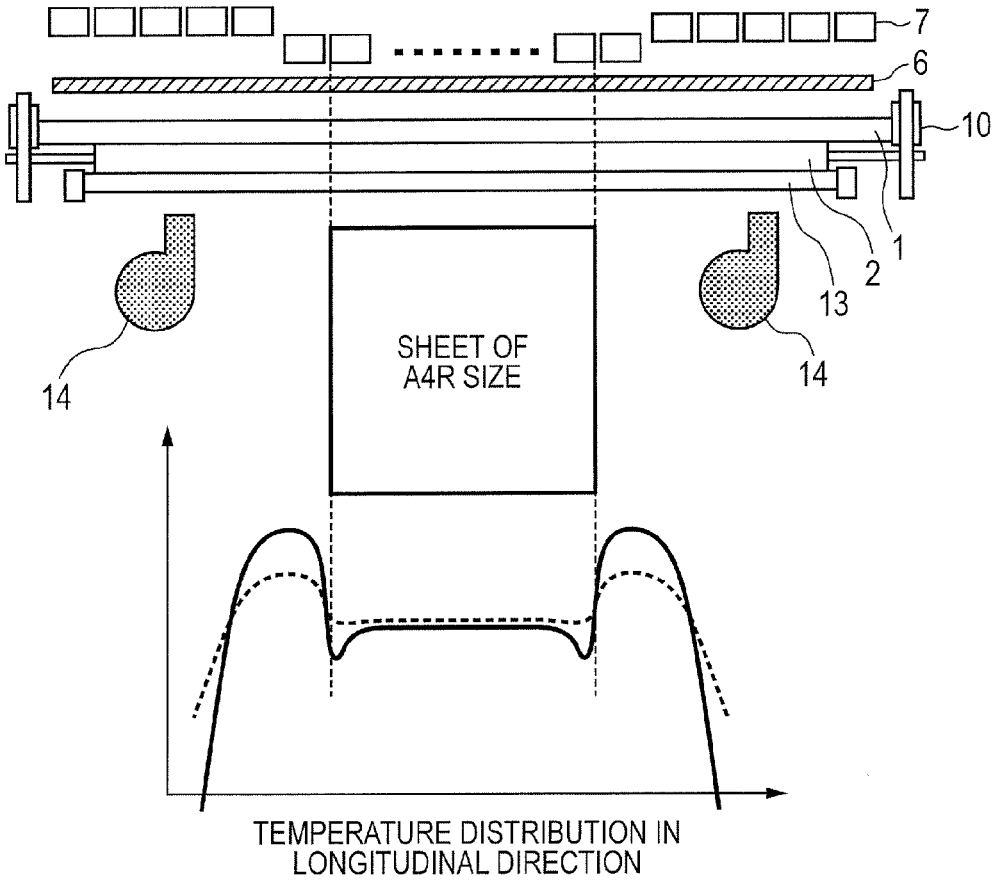
FIG. 9 is a view illustrating temperature distributions in a width direction of the fixing belt.

FIG. 9 is a view illustrating temperature distributions in the width direction of the fixing belt 1 at a time point when a fixing process on the 150th sheet is completed through the sequence described above.

The solid line in FIG. 9 indicates a temperature distribution in a case where the end portion fans 14 are not activated. When the end portion fans 14 are not activated, excessive temperature rises beyond an allowable level occur in the non-sheet passing regions on the fixing belt 1.

Meanwhile, when the configuration in the embodiment is employed, in other words, when the heat equalizing roller 13 is cooled by the end portion fans 14, as indicated by the dotted line in FIG. 9, the temperatures of the non-sheet passing regions of the fixing belt 1 can be maintained within a range of the allowable level. In addition, the temperature of the sheet passing region of the fixing belt 1 is maintained at a level equal to or higher than the target temperature.

As a result, even on the 150th recording sheet, gloss unevenness in the fixed image was able to be suppressed within a range of ±2.

This advantage is obtained by a heat conduction effect of the heat equalizing roller 13, specifically, obtained by conducting the heat in the non-sheet passing regions of the fixing belt 1 to the sheet passing region. In a case where the end portion fans 14 are activated in a stage in which the detection temperatures obtained from the end portion temperature sensors TH2 and TH3 are lower than the threshold temperatures, a conduction amount of the heat from the non-sheet passing regions to the sheet passing region is reduced. As a result, the temperature of the sheet passing region decreases at end portions thereof. As a countermeasure, it is preferred to set the threshold temperatures of the end portion temperature sensors TH2 and TH3 in consideration of the temperature decrease at the end portions of the sheet passing region.

Figure 10:
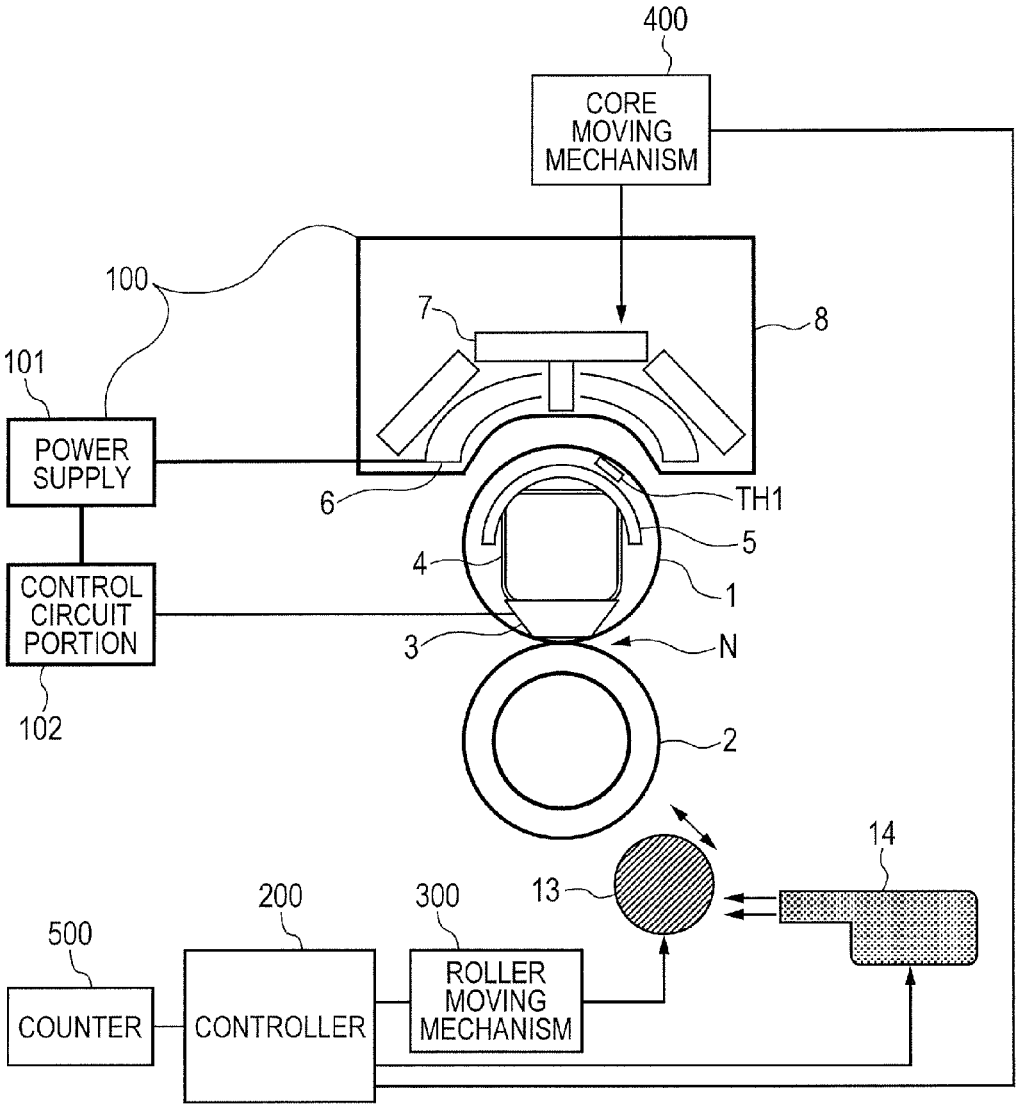
FIG. 10 is a vertical sectional view of a substantial part of another fixing apparatus, for illustrating another control system of the fixing apparatus.

Note that, as described above in the embodiment, at least one of an abutment timing of the heat equalizing roller 13 and an activation timing of the end portion fan is determined based on the detection temperatures obtained from the end portion temperature sensors TH2 and TH3, but the present invention is not limited to the embodiment. Alternatively, as illustrated, for example, in FIG. 10, the at least one of the abutment timing of the heat equalizing roller 13 and the activation timing of the end portion fan 14 may be determined based on the number of passing sheets at the time of continuously performing the fixing process on the plurality of recording sheets P. In other words, the number of passing sheets during the job of the continuous fixing processes is counted by a counter (passing sheet counting unit) 500. Specifically, as described above in the section of "(10) Sequence of continuous fixing processes on small size recording sheets" the heat equalizing roller 13 may be brought into abutment against the pressure roller 2 after the fixing process on the 27th sheet is completed during the job of the continuous fixing processes, and the end portion fan 14 may be activated after the fixing process on the 100th sheet is completed during the job of the continuous fixing processes.

As described above, by employing the configurations in the embodiments of the present invention, the non-sheet passing portion temperature rises in the fixing belt 1 was reduced, with the result that a service life of the fixing belt 1 was prevented from being shortened. Further, the temperature in the sheet passing region of the fixing belt 1 was able to be equalized, with the result that images free from gloss unevenness were able to be obtained.

Note that, in the above description of the embodiments of the present invention, the fixing belt 1 is inductively heated by the exciting coil 6, but the present invention is not limited thereto. For example, a halogen lamp may be provided as a heating source on the inner side of the fixing belt 1.

Further, in the above description of the embodiments of the present invention, the fixing belt 1 is exemplified as a fixing member (first rotating member), but alternatively, a fixing roller may be used. Note that, in terms of shortening the time period for the warm-up operation, the configurations of the first embodiment and the second embodiment of the present invention are more preferred. Further, the pressure roller 2 is exemplified as a pressure member (second rotating member or driving roller), but alternatively, a pressure belt may be used.

Still further, in the case exemplified in the above description of the embodiments of the present invention, the pressure roller 2 is used as a pressure member (second rotating member or driving roller) and the fixing belt 1 is rotated by the rotation of the pressure roller 2, but the present invention is not limited thereto. For example, a fixed pressure pad may be used as the pressure member, and the fixing belt 1 may be stretched around a driving pulley and a driven pulley and rotated by them.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2012-011904, filed on Jan. 24, 2012, which is hereby incorporated by reference herein in its entirety.

What is claimed is:

1. An image heating apparatus, comprising:

a first rotating member configured to heat a toner image on a sheet at a nip portion;

a second rotating member configured to form the nip portion cooperatively with said first rotating member;

a heat conduction member configured to conduct heat of said second rotating member in a width direction of said second rotating member;

a moving mechanism configured to move said heat conduction member between an operating position in which said heat conduction member is in contact with said second rotating member and a non-operating position in which said heat conduction member is spaced apart from said second rotating member;

a detector configured to detect a temperature of said first rotating member;

a controller configured to control an operation of said moving mechanism according to an output from said detector; and a fan configured to blow air toward a predetermined region of said heat conduction member in the operating position.

2. An image heating apparatus according to claim 1, wherein said fan is arranged in a position in which said fan is opposite to said heat conduction member in the operating position.

3. An image heating apparatus according to claim 1, wherein the predetermined region of said heat conduction member is a region on one end of said heat conduction member in a width direction of said heat conduction member.

4. An image heating apparatus according to claim 3, further comprising another fan configured to blow air toward a predetermined region on the other end side of said heat conduction member in the width direction of said heat conduction member.

5. An image heating apparatus according to claim 1, wherein said controller controls said moving mechanism so that said moving mechanism moves said heat conduction member to the operating position when a detection temperature obtained from said detector rises to a first temperature.

6. An image heating apparatus according to claim 5, wherein said controller operates said fan when the detection temperature obtained from said detector rises to a second temperature higher than the first temperature.

7. An image heating apparatus according to claim 6, wherein said controller controls the amount of the air to be supplied from said fan according to the output from said detector.

8. An image heating apparatus according to claim 6, wherein said detector is configured to detect the temperature of a part of one end portion of said first rotating member in a width direction of said first rotating member.

9. An image heating apparatus according to claim 1, further comprising an exciting coil configured to inductively heat said first rotating member.

10. An image heating apparatus according to claim 9, further comprising a magnetic flux suppressing mechanism configured to suppress, when an image heating process is performed on a predetermined sheet having a width smaller than a maximum width applicable to the image heating apparatus, among magnetic fluxes generated from said exciting coil toward said first rotating member, magnetic fluxes generated toward a region on an outer side of said first rotating member in a width direction of said first rotating member with respect to a region in which said first rotating member is to be brought into contact with the predetermined sheet.

11. An image heating apparatus according to claim 10, wherein said magnetic flux suppressing mechanism comprises a plurality of magnetic cores arranged along the width direction of said first rotating member, and wherein, when the image heating process is performed on the predetermined sheet, said magnetic flux suppressing mechanism moves at least one of said plurality of magnetic cores away from said first rotating member so as to suppress the magnetic fluxes generated toward the region on the outer side of said first rotating member in the width direction of said first rotating member.

12. An image heating apparatus according to claim 1, wherein said heat conduction member comprises a metal roller which is abuttable against an entire region of said second rotating member in the width direction of said second rotating member.

13. An image heating apparatus, comprising:

an endless belt configured to heat a toner image on a sheet at a nip portion;

a driving roller configured to form the nip portion cooperatively with said endless belt and to drive said endless belt to rotate;

an exciting coil configured to inductively heat said endless belt;

a plurality of magnetic cores arranged along a width direction of said endless belt;

a core moving mechanism configured to move at least one of said plurality of magnetic cores away from said endless belt when an image heating process is performed on a predetermined sheet having a width smaller than a maximum width applicable to the image heating apparatus;

a heat conduction roller configured to conduct heat of said driving roller in a longitudinal direction of said driving roller in an operating position in which said heat conduction roller is in contact with said driving roller;

a detector configured to detect the temperature of a part of said endless belt on one end portion thereof in a longitudinal direction of said endless belt other than a region of said endless belt in which said endless belt is to be brought into contact with the predetermined sheet;

a roller moving mechanism configured to move said heat conduction roller between the operating position and a non-operating position in which said heat conduction roller is spaced apart from said driving roller;

a fan configured to blow air toward a part of said heat conduction roller on one end of said heat conduction roller in a longitudinal direction thereof which is in the operating position so as to cool the part of said endless belt on the one end portion in the longitudinal direction of said endless belt; and a controller configured to control an operation of said roller moving mechanism and an operation of said fan according to an output from said detector.

14. An image heating apparatus according to claim 13, wherein said fan is arranged in a position in which said fan is opposite to said heat conduction roller in the operating position.

15. An image heating apparatus according to claim 13, wherein said controller controls said roller moving mechanism so that said roller moving mechanism moves said heat conduction roller to the operating position when a detection temperature obtained from said detector rises to a first temperature.

16. An image heating apparatus according to claim 15, wherein said controller operates said fan when the detection temperature obtained from said detector rises to a second temperature higher than the first temperature.

17. An image heating apparatus according to claim 16, wherein said controller controls the amount of the air to be supplied from said fan according to the output from said detector.

18. An image heating apparatus according to claim 13, further comprising:

another detector configured to detect a temperature of a part of said endless belt on the other end in the longitudinal direction of said endless belt with respect to the region of said endless belt in which said endless belt is to be brought into contact with the predetermined sheet; and another fan configured to blow air toward a part of said heat conduction roller on the other end in the longitudinal direction of said heat conduction roller, wherein said controller controls the operation of said fan and an operation of said another fan.

19. An image heating apparatus according to claim 18, wherein said controller controls said roller moving mechanism so that said roller moving mechanism moves said heat conduction roller to the operating position when a detection temperature obtained from said detector rises to a first temperature.

20. An image heating apparatus according to claim 19, wherein said controller operates said fan and said another fan when the detection temperature obtained from said detector rises to a second temperature higher than the first temperature.

21. An image heating apparatus according to claim 20, wherein said controller controls the amount of the air to be supplied from said fan according to the output from said detector.

22. An image heating apparatus according to claim 13, wherein said heat conduction roller comprises a metal roller which is abuttable against an entire region of said driving roller in the longitudinal direction of said driving roller.

23. An image heating apparatus, comprising:

a first rotating member configured to heat a toner image on a sheet at a nip portion;

a second rotating member configured to form the nip portion cooperatively with said first rotating member;

a heat conduction member configured to conduct heat of said second rotating member in a width direction of said second rotating member in an operating position in which said heat conduction member is in contact with said second rotating member;

a counter configured to count the number of the sheets when an image heating process is performed continuously on each of a plurality of the sheets;

a controller configured to control an operation of said moving mechanism according to an output from said counter; and a fan configured to blow air toward a predetermined region of said heat conduction member which is in the operating position.

24. An image heating apparatus according to claim 23, wherein said fan is arranged in a position in which said fan is opposite to said heat conduction member in the operating position.

25. An image heating apparatus according to claim 23, wherein the predetermined region of said heat conduction member is a region on one end of said heat conduction member in a width direction of said heat conduction member.

26. An image heating apparatus according to claim 25, further comprising another fan configured to blow air toward a predetermined region on other end side of said heat conduction member in the width direction of said heat conduction member.

27. An image heating apparatus according to claim 23, further comprising a moving mechanism configured to move said heat conduction member between the operating position and a non-operating position in which said heat conduction member is spaced apart from said second rotating member, wherein said controller controls said moving mechanism so that said moving mechanism moves said heat conduction member to the operating position when the number of the sheets, which is counted by said counter, reaches a first number of sheets.

28. An image heating apparatus according to claim 27, wherein said controller operates said fan when the number of the sheets, which is counted by said counter, reaches a second number of sheets larger than the first number of sheets.

29. An image heating apparatus according to claim 23, further comprising an exciting coil configured to inductively heat said first rotating member.

30. An image heating apparatus according to claim 29, further comprising a magnetic flux suppressing mechanism configured to suppress, when the image heating process is performed on a predetermined sheet having a width smaller than a maximum width applicable to the image heating apparatus, among magnetic fluxes generated from said exciting coil toward said first rotating member, magnetic fluxes generated toward a region on an outer side of said first rotating member in a width direction of said first rotating member with respect to a region in which said first rotating member is to be brought into contact with the predetermined sheet.

31. An image heating apparatus according to claim 30, wherein said magnetic flux suppressing mechanism comprises a plurality of magnetic cores arranged along the width direction of said first rotating member, and wherein, when the image heating process is performed on the predetermined sheet, said magnetic flux suppressing mechanism moves at least one of said plurality of magnetic cores away from said first rotating member so as to suppress the magnetic fluxes generated toward the region on the outer side of said first rotating member in the width direction of said first rotating member.

32. An image heating apparatus according to claim 23, wherein said heat conduction member comprises a metal roller which is abuttable against an entire region of said second rotating member in the width direction of said second rotating member.

* * * * *